US012752997B2

(12) United States Patent
Kremmel et al.

(10) Patent No.: US 12,752,997 B2
(45) Date of Patent: Oct. 6, 2026

(54) MOLDED PULP PACKAGING INSERT FOR A DISHWASHER APPLIANCE

(71) Applicant: Haier US Appliance Solutions, Inc., Wilmington, DE (US)

(72) Inventors: Aldo Vincent Kremmel, Palmyra, IN (US); Kyle James Brewer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 142 days.

(21) Appl. No.: 18/811,262

(22) Filed: Aug. 21, 2024

(65) Prior Publication Data

US 2026/0054907 A1 Feb. 26, 2026

(51) Int. Cl.

| | |
|---|---|
| ***B65D 81/05*** | (2006.01) |
| ***A47L 15/42*** | (2006.01) |
| ***A47L 15/50*** | (2006.01) |
| ***B65D 85/68*** | (2006.01) |

(52) U.S. Cl.

CPC ..... *B65D 81/05* (2013.01); *A47L 15/4268* (2013.01); *A47L 15/50* (2013.01); *B65D 85/68* (2013.01); *B65D 2581/053* (2013.01); *B65D 2585/6815* (2013.01)

(58) Field of Classification Search

CPC .. B65D 81/05; B65D 85/68; B65D 2581/053; B65D 2585/6815

USPC ..... 206/320, 521, 584–593

See application file for complete search history.

(56) References Cited

U.S. PATENT DOCUMENTS

| | | | | | |
|---|---|---|---|---|---|
| 2,560,249 | A * | 7/1951 | Risch | B65D 81/057 | 206/586 |
| 4,120,441 | A * | 10/1978 | Hurley | B65D 5/5088 | 206/586 |
| 4,742,916 | A * | 5/1988 | Galea | B65D 81/054 | 206/586 |
| 6,405,873 | B2 * | 6/2002 | Koike | B65D 81/025 | 206/320 |
| 10,099,836 | B2 * | 10/2018 | Cheich | B65D 81/052 | |
| 10,368,716 | B2 | 8/2019 | Dirisala et al. | | |
| 12,084,254 | B2 * | 9/2024 | Buhl | B65D 5/5035 | |
| 2024/0034546 | A1 | 2/2024 | Juen et al. | | |

FOREIGN PATENT DOCUMENTS

| | | | | |
|---|---|---|---|---|
| CN | 220024985 U | | 11/2023 | |
| KR | 20050123193 A | | 12/2005 | |
| KR | 20170137473 A | * | 12/2017 | A47L 15/501 |
| KR | 20170137475 A | * | 12/2017 | A47L 15/501 |
| KR | 20210120479 A | | 10/2021 | |
| KR | 102643354 B1 | | 3/2024 | |

* cited by examiner

*Primary Examiner* — Bryon P Gehman

(74) *Attorney, Agent, or Firm* — Dority & Manning, P.A.

(57) ABSTRACT

A dishwasher appliance includes a tub defining a receiving chamber; at least one rack assembly removably positioned within the receiving chamber, the at least one rack assembly including a wire frame member; and a rack piece removably positioned within the at least one rack assembly. The rack piece includes a central rib extending along the vertical direction; a first flange protruding from the central rib along a first direction; and a second flange protruding from the central rib along a second direction different from the first direction, wherein the rack piece is formed from a recyclable molded pulp material.

14 Claims, 4 Drawing Sheets

MOLDED PULP PACKAGING INSERT FOR A DISHWASHER APPLIANCE

FIELD OF THE INVENTION

The present subject matter relates generally to domestic appliances, and more particularly to packing materials for dishwasher appliances.

BACKGROUND OF THE INVENTION

Dishwasher appliances generally include a tub defining a receive space, a door to open and close the tub, and one or more racks removable positioned within the receiving space. The racks may include rollers which selectively roll along tracks attached to an interior surface of the tub such that a user may selectively remove the racks by rolling them outward via the rollers and racks. During packing and transport of the dishwasher appliance, the racks should be secured or locked into place to avoid movement which may cause damage to the appliance or one or more of attachments included therein.

Conventional dishwasher appliance may include blocks, ties, padding, or other securing features to ensure the racks stay stabilized during transit. However, existing methods have certain drawbacks. For instance, many padding or packaging materials are made from non-recyclable foam such as polystyrene foam, expandable polystyrene foam, or the like. Further, existing forming and creation methods of such pieces limit specific shapes, sizes, or features, leading to limited usability and full function.

Accordingly, a packaging piece for a dishwasher appliance which obviates one or more of the above-mentioned drawbacks would be beneficial. In particular, a molded pulp rack packaging piece would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwasher appliance defining a vertical direction, a lateral direction, and a transverse direction is provided, including a tub defining a receiving chamber, at least one rack assembly removably positioned within the receiving chamber, the at least one rack assembly comprising at least one elongated frame member, and a rack piece removably positioned within the at least one rack assembly. The rack piece includes a central rib extending along the vertical direction, a first flange protruding from the central rib along a first direction, and a second flange protruding from the central rib along a second direction different from the first direction, wherein the rack piece is formed from a recyclable molded pulp material.

In another exemplary aspect of the present disclosure, a rack piece for a dishwasher appliance is provided. The dishwasher appliance defines a vertical direction, a lateral direction, and a transverse direction and includes at least one rack assembly removably installed within a tub. The rack piece includes a central rib extending along the vertical direction, a first flange protruding from the central rib along a first direction, and a second flange protruding from the central rib along a second direction different from the first direction, wherein the rack piece is formed from a recyclable molded pulp material.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
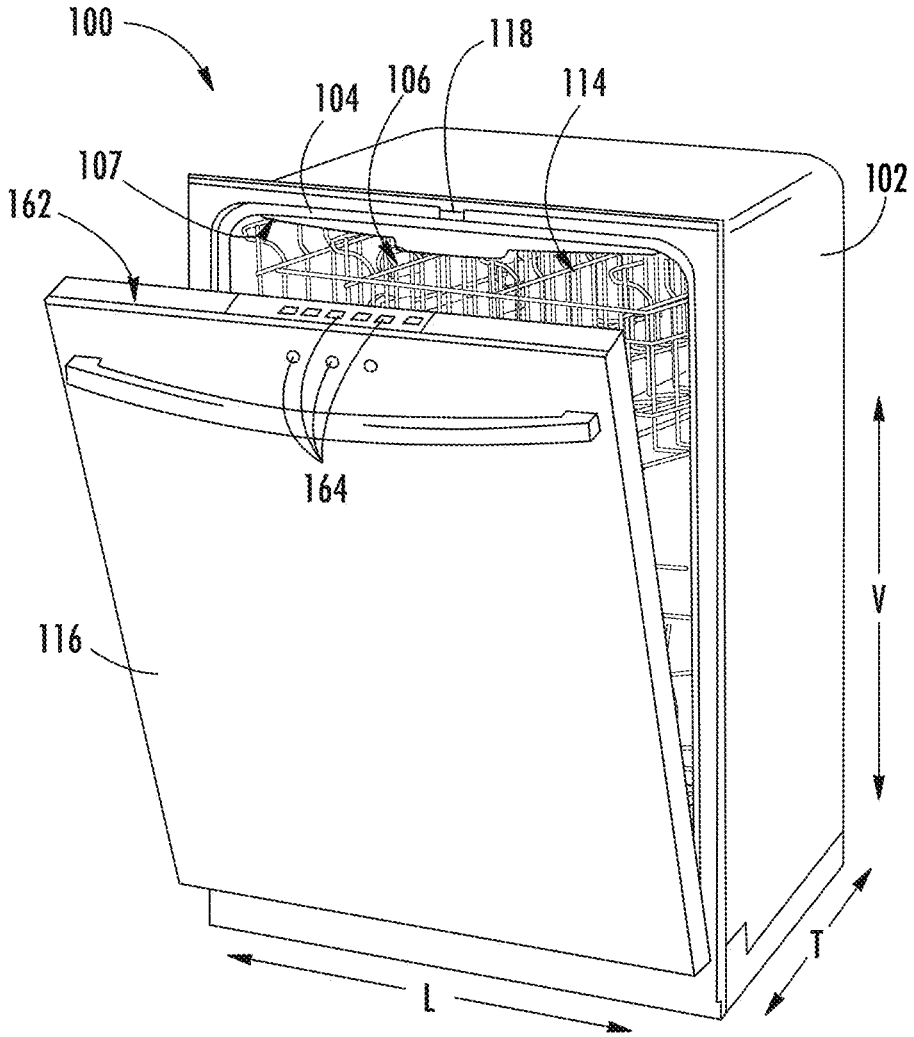
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
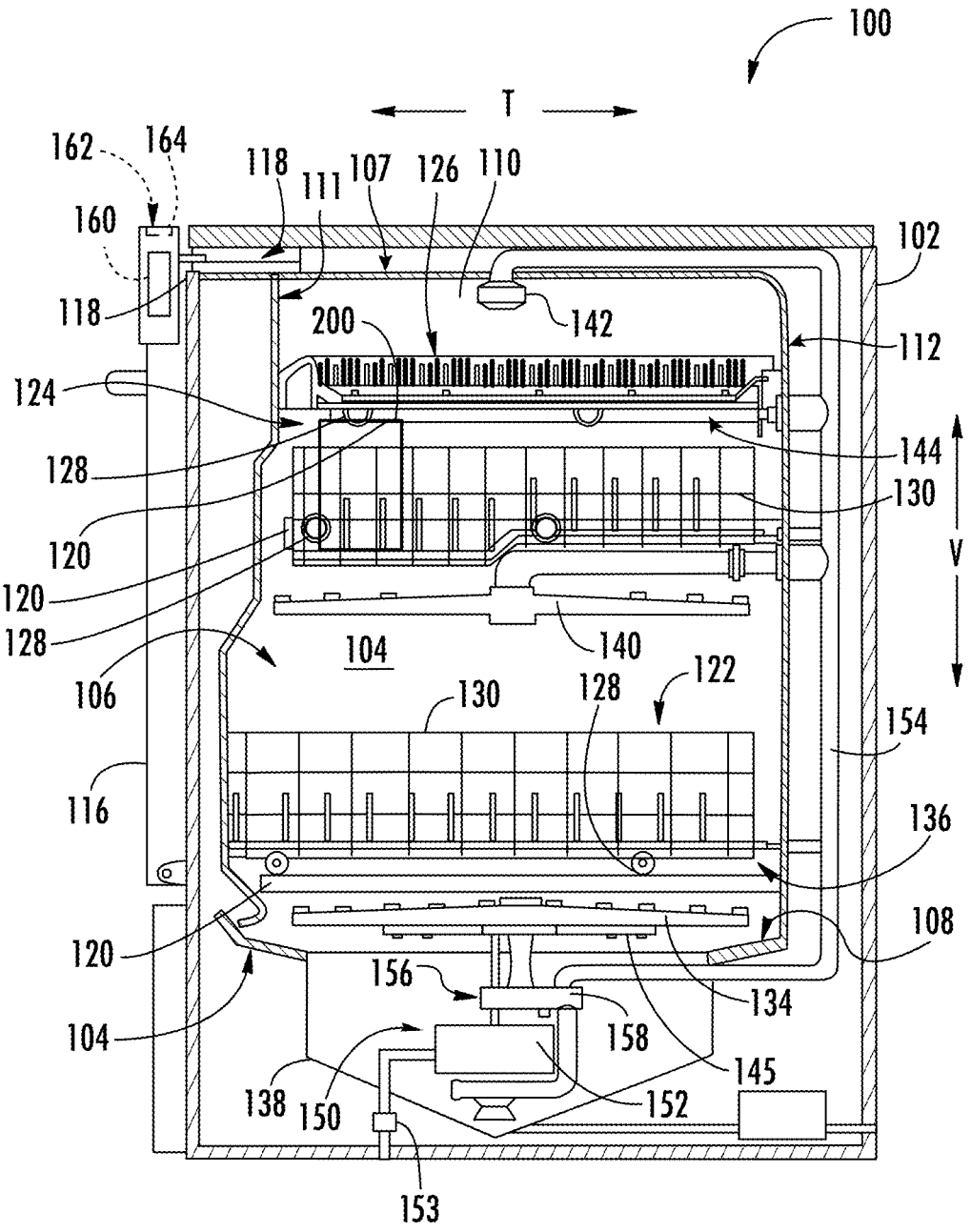
FIG. 2 provides a side, cross-sectional view of the exemplary dishwashing appliance of FIG. 1.

Turning now to the figures, FIGS. 1 and 2 depict an exemplary dishwasher or dishwasher appliance (e.g., dishwasher appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 may include a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 may include a front opening 114 (FIG. 1). In some embodiments, dishwasher appliance 100 may also include a door 116 at the front opening 114. Door 116 may, for example, be hinged at its bottom for movement between a normally closed vertical position, wherein wash chamber 106 is sealed shut for washing operations, and a horizontal open position for loading and unloading of articles from dishwasher 100. A door closure mechanism or assembly 118 may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). For instance, the lattice structures and wires or elongated members 130 may be formed from any suitable material, such as coated metal, plastic, polymer, or the like. In this regard, rack assemblies 122, 124, 126 are generally configured for supporting articles within wash chamber 106 while allowing a flow of wash liquid to reach and impinge on those articles (e.g., during a cleaning or rinsing cycle). According to additional or alternative embodiments, a silverware basket may be removably attached to a rack assembly (e.g., lower rack assembly 122), for placement of silverware, utensils, and the like, that are otherwise too small to be accommodated by the rack assembly.

Generally, dishwasher 100 may include one or more spray assemblies for urging a flow of fluid (e.g., wash liquid) onto the articles placed within wash chamber 106. In exemplary embodiments, dishwasher 100 includes a lower spray arm assembly 134 disposed in a lower region 136 of wash chamber 106 and above a sump 138 so as to rotate in relatively close proximity to lower rack assembly 122. In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash liquid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash liquid downward over rack assemblies 122, 124, and 126. In yet further additional or alternative embodiments, upper rack assembly 126 may further define an integral spray manifold 144. As illustrated, integral spray manifold 144 may be directed upward, and thus generally configured for urging a flow of wash liquid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly (not shown). For instance, filter clean spray assembly 145 may be directed downward to urge a flow of wash liquid across a portion of filter assembly or sump 138.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be located within sump 138 or within a machinery compartment located below sump 138 of tub 104.

When assembled, circulation pump 152 may be in fluid communication with an external water supply line (not shown) and sump 138. A water inlet valve 153 may be positioned between the external water supply line and circulation pump 152 (e.g., to selectively allow water to flow from the external water supply line to circulation pump 152). Additionally or alternatively, water inlet valve 153 may be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to close and thereby cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash liquid throughout wash chamber 106.

In some embodiments, primary supply conduit 154 is used to supply wash liquid to one or more spray assemblies (e.g., to mid-level spray arm assembly 140 or upper spray assembly 142). It should be appreciated, however, that according to alternative embodiments, any other suitable plumbing configuration may be used to supply wash liquid throughout the various spray manifolds and assemblies described herein. For instance, according to another exemplary embodiment, primary supply conduit 154 could be used to provide wash liquid to mid-level spray arm assembly 140 and a dedicated secondary supply conduit (not shown) could be utilized to provide wash liquid to upper spray assembly 142. Other plumbing configurations may be used for providing wash liquid to the various spray devices and manifolds at any location within dishwashing appliance 100.

Each spray arm assembly 134 and 140, upper spray assembly 142, integral spray manifold 144, filter clean assembly 145, or other spray device may include an arrangement of discharge ports or orifices for directing wash liquid received from circulation pump 152 onto dishes or other articles located in wash chamber 106. The arrangement of the discharge ports, also referred to as jets, apertures, or orifices, may provide a rotational force by virtue of wash liquid flowing through the discharge ports. Alternatively, spray assemblies 134, 140, 142, 145 may be motor-driven, or may operate using any other suitable drive mechanism. Spray manifolds and assemblies may also be stationary. The resultant movement of the spray assemblies 134, 140, 142, 145 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In optional embodiments, circulation pump 152 urges or pumps wash liquid (e.g., from the filter assembly) to a diverter 156 (FIG. 2). In some such embodiments, diverter 156 is positioned within sump 138 of dishwashing appliance 100). Diverter 156 may include a diverter disk (not shown) disposed within a diverter chamber 158 for selectively distributing the wash liquid to the spray assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash liquid to the desired spray device.

In exemplary embodiments, diverter 156 is configured for selectively distributing the flow of wash liquid from circulation pump 152 to various fluid supply conduits—only some of which are illustrated in FIG. 2 for clarity. In certain embodiments, diverter 156 includes four outlet ports (not shown) for supplying wash liquid to a first conduit for rotating lower spray arm assembly 134, a second conduit for supplying wash liquid to filter clean assembly 145, a third conduit for spraying an auxiliary rack such as the silverware rack, and a fourth conduit for supply mid-level or upper spray assemblies 140, 142 (e.g., primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 may be in operative communication with a user interface panel 162 through which a user may select various operational features and modes and monitor progress of the dishwasher 100. In one embodiment, the user interface 162 may represent a general purpose I/O ("GPIO") device or functional block. In certain embodiments, the user interface 162 includes input components 164, such as one or more of a variety of electrical, mechanical or electromechanical input devices including capacitive touch screens/buttons, rotary dials, push buttons, and touch pads. The user interface 162 may further include one or more display components, such as a digital display device or one or more indicator light assemblies designed to provide operational feedback to a user. The user interface 162 may be in communication with the controller 160 via one or more signal lines or shared communication busses.

Figure 3:
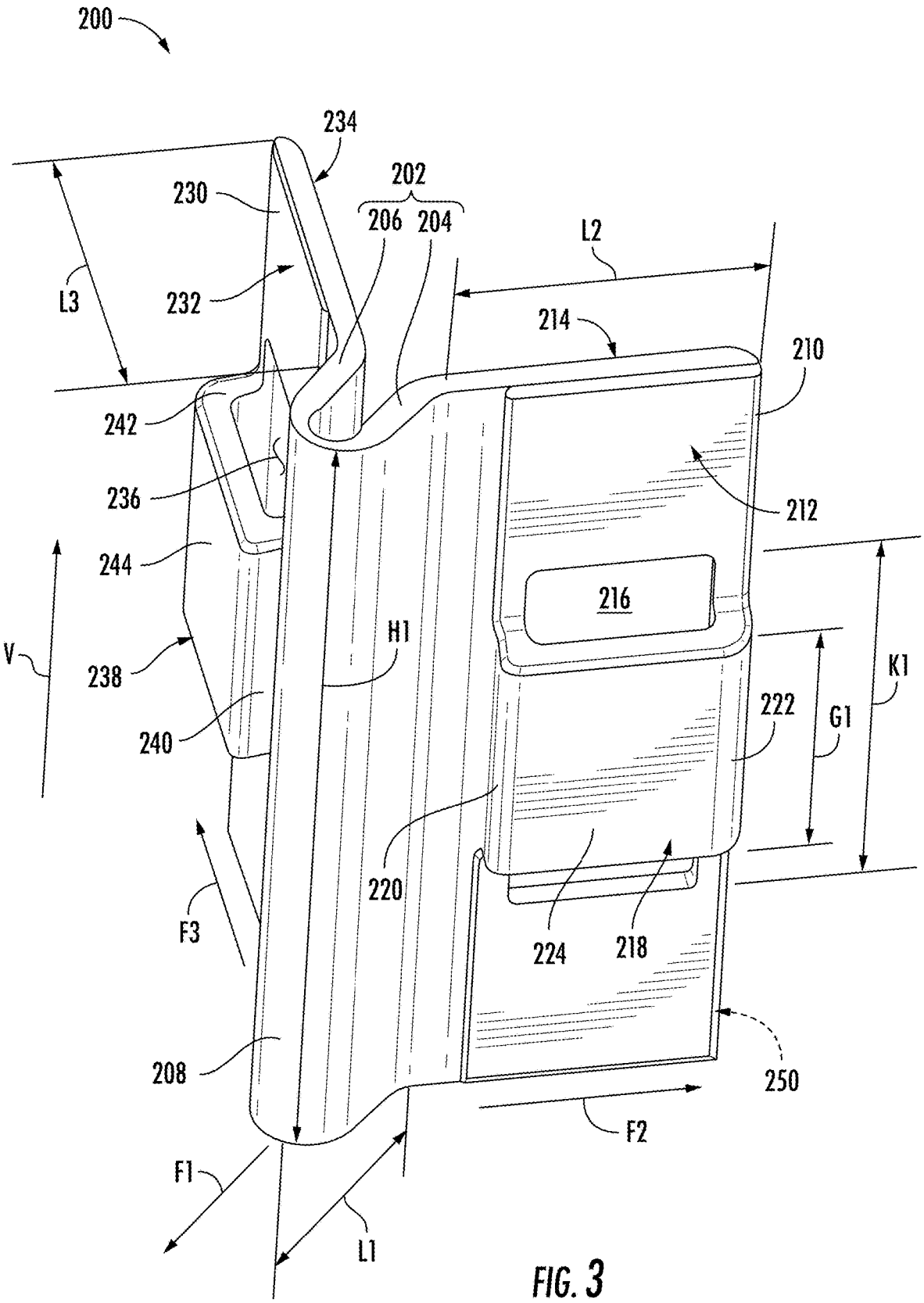
FIG. 3 provides a perspective view of a packaging piece for a dishwasher appliance according to exemplary embodiments of the present disclosure.
Figure 4:
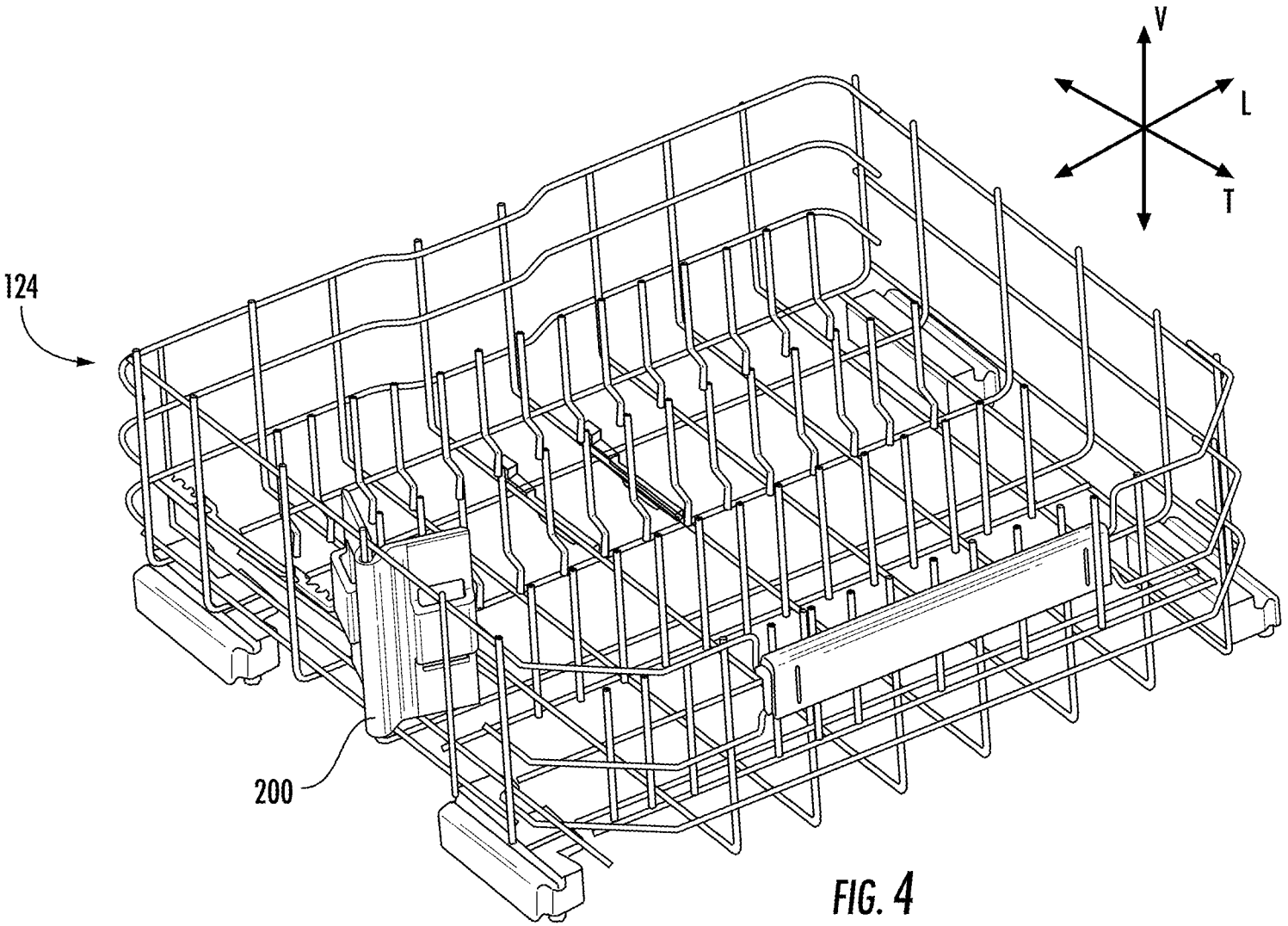
FIG. 4 provides a perspective view of a washing rack of a dishwasher appliance including the exemplary packaging piece of FIG. 3.

Referring now to FIGS. 3 through 4, an exemplary packaging piece will be described in detail. Dishwasher 100 may include one or more packaging materials which secure pieces (e.g., rack assemblies 122, 124, 126) during packing and transport. The packaging materials may include a rack piece 200. For instance, rack piece 200 may be attached to or accommodated within at least one rack assembly (e.g., middle rack assembly 124) at assembly for securing the at least one rack assembly for transit. In some embodiments, rack piece 200 is positioned within two or more tines (e.g., wires, elongated members, etc.) of middle rack assembly 124 and abutted against a bottom panel of upper rack assembly 126. For the sake of brevity hereinafter, rack piece 200 will be described with reference to an installation within middle rack assembly 124 with the understanding that rack piece 200 may be attached to, installed at, or otherwise placed on any suitable item or element (e.g., such as lower rack assembly 124, upper rack assembly 126, etc.).

Rack piece 200 may be formed from a molded pulp material. In detail, molded pulp may include one or more recycled or recyclable materials, such as recycled paperboard, newsprint, paper packaging, cardboard, or the like. Rack piece 200 may include thick-walled molded, or slush molded pulp material capable of providing rigidity and maintaining shape through minor force applied thereto. In additional or alternative embodiments, rack piece 200 include thin-walled molded pulp, including two or more layers of thin-walled molded pulp to form a single rack piece 200. However, it should be understood that the disclosure is not limited to the examples provided herein, and rack piece may include thermoformed fiber molded pulp, processed molded pulp, any combination of two or more forms of molded pulp, or the like.

Rack piece 200 may include a central rib 202. Central rib 202 may extend along the vertical direction V. For instance, central rib 202 may be elongated along the vertical direction V. Central rib 202 may include a first tab 204 and a second tab 206. First tab 204 and second tab 206 may be predominantly parallel with each other. In detail, each of first tab 204 and second tab 206 may extend or protrude along a first horizontal direction F1 (e.g., perpendicular to the vertical direction V). The first horizontal direction F1 may be defined between the lateral direction L and the transverse direction T.

First tab 204 and second tab 206 may each protrude a first length L1 along the first horizontal direction F1. First tab 204 and second tab 206 may be connected with each other via a joint piece 208. Joint piece 208 may be rounded (e.g., semi-circular) about the vertical direction V. Accordingly, first tab 204, second tab 206, and joint piece 208 may collectively form a "U" shape. Additionally or alternatively, central rib 202 may have a first predetermined height H1. For instance, first predetermined height H1 may vary according to a distance between middle rack assembly 124 and top rack assembly 126. Accordingly, first predetermined height H1 may be predominantly commensurate with a distance between a bottom of middle rack assembly 124 and a bottom of top rack assembly 126.

Rack piece 200 may include a first flange 210. First flange 210 may protrude from central rib 202. In detail, first flange 210 may protrude from central rib 202 along a second horizontal direction F2. The second horizontal direction F2 may be different from the first horizontal direction F1. For instance, the second horizontal direction F2 may be defined between the lateral direction L and the transverse direction T different from the first horizontal direction F1.

First flange 210 may protrude from first tab 204 of central rib 202. For instance, first flange 210 may protrude from a distal edge of first rib (e.g., opposite joint piece 208). According to some embodiments, an angle between central rib 202 and first flange 210 is between about 140 degrees and about 160 degrees. However, it should be understood that the dimensions provided herein are by way of example only.

First flange 210 may protrude a second length L2 from central rib 202 (e.g., along the second horizontal direction F2). For instance, second length L2 may be greater than first length L1. In some instances, second length L2 is between about 3 times greater and about 5 times greater than first length L1.

First flange 210 may define a first flange face 212 and a second flange face 214 opposite first flange face 212. In detail, first flange face 212 may face a direction perpendicular to the second horizontal direction F2. According to some embodiments, second flange face 214 is predominantly parallel with first flange face 212. Second flange face 214 may thus face a direction opposite first flange face 212 (e.g., perpendicular to the second horizontal direction F2).

First flange 210 may include a first aperture 216. First aperture 216 may be defined through first flange face 212. For instance, first aperture 216 may be a through aperture defined through each of first flange face 212 and second flange face 214. First aperture 216 may be predominantly rectangular in shape (e.g., cross-section through first flange face 212). In some embodiments, a height K1 of first aperture 216 along the vertical direction V is greater than a width of first aperture 216 along the second horizontal direction F2.

First flange 210 may include a first tab 218. First tab 218 may at least partially cover or overlap first aperture 216 (e.g., along the direction perpendicular to the second horizontal direction F2, or normal to first flange face 212). According to at least some embodiments, first tab 218 may protrude from first flange face 212. Accordingly, at least a portion of first tab 218 may be predominantly parallel with first flange face 212.

In detail, first tab 218 may include a first arm 220, a second arm 222, and a cross panel 224. First arm 220 may protrude from first flange face 212 at a first lateral side of first aperture 216. For instance, first arm 220 may be proximate to central rib 202. First arm 220 may protrude a predetermined distance from first flange face 212. In some instances, the protrusion distance of first arm 220 is between about 1% and about 10% of second length L2.

Second arm 222 may protrude from first flange face 212 at a second lateral side of first aperture 216 (e.g., opposite first arm 220). For instance, second arm 222 may be distal to central rib 202. Second arm 222 may protrude a predetermined distance from first flange face 212. In some instances, the protrusion distance of second arm 222 is equal to the protrusion distance of first arm 220 (e.g., between about 1% and about 10% of second length L2).

Cross panel 224 may connect first arm 220 with second arm 222. For instance, cross panel 224 may be positioned across first aperture 216. Thus, cross panel 224 may at least partially overlap or cover first aperture 216. Cross panel 224 may define a height G1 along the vertical direction V. Height G1 of cross panel 224 may be less than height K1 of first aperture 216 along the vertical direction V. However, it should be understood that the dimensions provided herein are by way of example only, and that any suitable dimensions may be incorporated into specific embodiments or applications.

Rack piece 200 may include a second flange 230. Second flange 230 may protrude from central rib 202. In detail, second flange 230 may protrude from central rib 202 along a third horizontal direction F3. The third horizontal direction F3 may be different from each of the first horizontal direction F1 and the second horizontal direction F2. For instance, the third horizontal direction F3 may be defined between the lateral direction L and the transverse direction T different from the first horizontal direction F1 and the second horizontal direction F2.

Second flange 230 may protrude from second tab 206 of central rib 202. For instance, second flange 230 may protrude from a distal edge of second rib (e.g., opposite joint piece 208). According to some embodiments, an angle between central rib 202 and second flange 230 is between about 140 degrees and about 160 degrees. However, it should be understood that the dimensions provided herein are by way of example only.

Second flange 230 may protrude a third length L3 from central rib 202 (e.g., along the third horizontal direction F3). For instance, third length L3 may be greater than first length L1. In some instances, third length L3 is between about 3 times greater and about 5 times greater than first length L1. Additionally or alternatively, third length L3 may be substantially equal to second length L2.

Second flange 230 may define a third flange face 232 and a fourth flange face 234 opposite third flange face 232. In detail, third flange face 232 may face a direction perpendicular to the third horizontal direction F3. According to some embodiments, fourth flange face 234 is predominantly parallel with third flange face 232. Fourth flange face 234 may thus face a direction opposite third flange face 232 (e.g., perpendicular to the third horizontal direction F3).

Second flange 230 may include a second aperture 236. Second aperture 236 may be defined through third flange face 232. For instance, second aperture 236 may be a through aperture defined through each of third flange face 232 and fourth flange face 234. Second aperture 236 may be predominantly rectangular in shape (e.g., cross-section through third flange face 232). In some embodiments, a height of second aperture 236 along the vertical direction V is greater than a width of second aperture 236 along the third horizontal direction F3.

Second flange 230 may include a second tab 238. Second tab 238 may at least partially cover or overlap second aperture 236 (e.g., along the direction perpendicular to the third horizontal direction F3, or normal to third flange face 232). According to at least some embodiments, second tab 238 may protrude from third flange face 232. Accordingly, at least a portion of second tab 238 may be predominantly parallel with third flange face 232.

In detail, second tab 238 may include a first arm 240, a second arm 242, and a cross panel 244. First arm 240 may protrude from third flange face 232 at a first lateral side of second aperture 236. For instance, first arm 240 may be proximate to central rib 202. First arm 240 may protrude a predetermined distance from third flange face 232. In some instances, the protrusion distance of first arm 240 is between about 1% and about 10% of third length L3.

Second arm 242 may protrude from third flange face 232 at a second lateral side of second aperture 236 (e.g., opposite first arm 240). For instance, second arm 242 may be distal to central rib 202. Second arm 242 may protrude a predetermined distance from third flange face 232. In some instances, the protrusion distance of second arm 242 is equal to the protrusion distance of first arm 240 (e.g., between about 1% and about 10% of third length L3).

Cross panel 244 may connect first arm 240 with second arm 242. For instance, cross panel 244 may be positioned across second aperture 236. Thus, cross panel 244 may at least partially overlap or cover second aperture 236. Cross panel 244 may define a height along the vertical direction V. The height of cross panel 244 may be less than the height of second aperture 236 along the vertical direction V (e.g., similar to cross panel 224 and first aperture 216). However, it should be understood that the dimensions provided herein are by way of example only, and that any suitable dimensions may be incorporated into specific embodiments or applications.

According to some embodiments, rack piece 200 may include a coating 250. Coating 250 may be applied to rack piece 200 after a formation thereof. As mentioned, rack piece 200 may be formed from a recyclable molded pulp material (e.g., through shaping, compressing, etc.). Once the general shape of rack piece 200 is defined, rack piece 200 may be provided with coating 250 (e.g., by dipping, painting, spraying, or the like). Coating 250 may include a wax coating. Advantageously, rack piece 200 may be waterproofed before being installed to middle rack assembly 124 (or any other portion or member within appliance 100).

According to some embodiments, rack piece 200 includes a hinge. The hinge may couple, for instance, first flange 210 (or second flange 230, or both) to a locking tab. The hinge may include a living hinge. For instance, the locking tab may be formed as part of rack piece 200 that is at least partially elastic. Thus, the locking tab may selectively deform with respect to rack piece 200 to allow rack piece 200 to be securely attached to, e.g., middle rack assembly 124.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction, the dishwasher appliance comprising:
- a tub defining a receiving chamber;
- at least one rack assembly removably positioned within the receiving chamber, the at least one rack assembly comprising at least one elongated frame member; and
- a rack piece removably positioned within the at least one rack assembly, the rack piece comprising:
  - a central rib extending along the vertical direction;
  - a first flange protruding from the central rib along a first direction, wherein the first flange defines a first flange face, the first flange comprising:
    - a first aperture defined through the first flange face; and
    - a first tab at least partially covering the first aperture, the first tab protruding from the first flange face; and
  - a second flange protruding from the central rib along a second direction different from the first direction, wherein the rack piece is formed from a recyclable molded pulp material.

2. The dishwasher appliance of claim 1, wherein a first height of the first flange along the vertical direction is equal to a second height of the second flange along the vertical direction.

3. The dishwasher appliance of claim 1, wherein the first flange further defines a second flange face opposite the first flange face, and wherein the second flange defines a third flange face and a fourth flange face opposite the third flange face.

4. The dishwasher appliance of claim 1, wherein the first tab comprises:

a first arm protruding from the first flange face at a first lateral side of the first aperture;

a second arm protruding from the first flange face at a second lateral side of the first aperture opposite the first arm; and a cross panel connecting the first arm with the second arm across the first aperture.

5. The dishwasher appliance of claim 4, wherein a height of the aperture along the vertical direction is greater than a height of the cross panel along the vertical direction.

6. The dishwasher appliance of claim 1, wherein the central rib protrudes along a third direction different from the first direction and the second direction.

7. The dishwasher appliance of claim 1, wherein the rack piece comprises a wax coating.

8. A rack piece for a dishwasher appliance, the dishwasher appliance defining a vertical direction, a lateral direction, and a transverse direction and comprising at least one rack assembly removably installed within a tub, the rack piece comprising:

a central rib extending along the vertical direction;

a first flange protruding from the central rib along a first direction, wherein the first flange defines a first flange face, the first flange comprising:

a first aperture defined through the first flange face; and a first tab at least partially covering the first aperture, the first tab protruding from the first flange face; and a second flange protruding from the central rib along a second direction different from the first direction, wherein the rack piece is formed from a recyclable molded pulp material.

9. The rack piece of claim 8, wherein a first height of the first flange along the vertical direction is equal to a second height of the second flange along the vertical direction.

10. The rack piece of claim 8, wherein the first flange further defines a second flange face opposite the first flange face, and wherein the second flange defines a third flange face and a fourth flange face opposite the third flange face.

11. The rack piece of claim 8, wherein the first tab comprises:

a first arm protruding from the first flange face at a first lateral side of the first aperture;

a second arm protruding from the first flange face at a second lateral side of the first aperture opposite the first arm; and a cross panel connecting the first arm with the second arm across the first aperture.

12. The rack piece of claim 11, wherein a height of the aperture along the vertical direction is greater than a height of the cross panel along the vertical direction.

13. The rack piece of claim 8, wherein the central rib protrudes along a third direction different from the first direction and the second direction.

14. The rack piece of claim 8, wherein the rack piece comprises a wax coating.

* * * * *